US006712116B2

(12) United States Patent
Beaudoin et al.

(10) Patent No.: US 6,712,116 B2
(45) Date of Patent: Mar. 30, 2004

(54) DRIVE MECHANISM FOR USE WITH AN OVERHEAD SHAFT OF A SECTIONAL DOOR

(75) Inventors: Michel Beaudoin, Drummondville (CA); Pierre-Louis Foucault, St-Lambert (CA); Richard Tremblay, Drummondville (CA); Jonathan Fréchette, Trois-Rivieres (CA)

(73) Assignee: Canimex Inc., Quebec (CA)

( * ) Notice: Subject to any disclaimer, the term of this patent is extended or adjusted under 35 U.S.C. 154(b) by 0 days.

(21) Appl. No.: 10/191,725

(22) Filed: Jul. 8, 2002

(65) Prior Publication Data

US 2003/0024658 A1 Feb. 6, 2003

(30) Foreign Application Priority Data

Jul. 6, 2001 (CA) ..... 2352620

(51) Int. Cl.[7] ..... E05F 15/00
(52) U.S. Cl. ..... 160/188; 160/201
(58) Field of Search ..... 160/188, 133, 160/189, 201, 300, 321, 1, 7, 8, 9; 74/625

(56) References Cited

U.S. PATENT DOCUMENTS 1,588,663 A * 6/1926 Collins ..... 160/188
1,997,846 A * 4/1935 Armstrong ..... 160/133
2,670,065 A * 2/1954 Stevens ..... 160/188
2,819,628 A * 1/1958 Wardlaw ..... 160/133
3,637,004 A * 1/1972 Wardlaw et al. ..... 160/133
3,853,167 A * 12/1974 Wardlaw ..... 160/188 X
6,155,324 A * 12/2000 Elliott et al. ..... 160/1 X
6,381,903 B1 * 5/2002 Desrochers et al. .... 160/310 X

FOREIGN PATENT DOCUMENTS

GB 1013115 12/1965
GB 2 294 412 A 5/1996

OTHER PUBLICATIONS

PCT International Search Report, Dated Oct. 15, 2002, 3 pages.

* cited by examiner

*Primary Examiner*—David Purol
(74) *Attorney, Agent, or Firm*—Merchant & Gould P.C.

(57) ABSTRACT

A drive mechanism for use with an overhead shaft of a sectional door for raising and lowering the door via a rotation of the overhead shaft. The drive mechanism has a support structure, a first gear, a drive shaft, a second gear, a pocket wheel and an actuator. The second gear is interconnected to the first gear so that a rotation of the second gear is transmitted to the first gear and vice versa. The pocket wheel is operable between first and second positions. The second gear is rotatable along a first direction corresponding to a raising of the sectional door and along an opposite second direction corresponding to a lowering of the sectional door. The actuator is used for rotating the pocket wheel about the drive shaft, operating the pocket wheel between the first and second positions, and driving the second gear along the first and second directions when the pocket wheel is in the second and first positions respectively. The drive mechanism includes a first ratchet assembly for blocking rotation of the second gear along the second direction when the pocket wheel is in the second position. The drive mechanism may also include a second ratchet assembly for blocking rotation of the second gear along the first direction when the pocket wheel is in the first position.

20 Claims, 6 Drawing Sheets

DRIVE MECHANISM FOR USE WITH AN OVERHEAD SHAFT OF A SECTIONAL DOOR

FIELD OF THE INVENTION

The present invention relates to a drive mechanism. More particularly, the present invention relates to drive mechanism for use with an overhead shaft of a sectional door, such as garage doors and the like, for raising and lowering the door, the drive mechanism having an integrated ratchet mechanism and acting also as a safety braking device for preventing an uncontrollable raising and/or lowering of the sectional door.

BACKGROUND OF THE INVENTION

It is known in the art that commercial and residential sectional garage doors usually require counterbalancing mechanisms to counterbalance the weight of the door in order to decrease the force required to open the door and also facilitate its closing from a raised to a lowered position. Large sectional garage doors used in commercial and residential applications may be manually or power operated. In either case, but particularly for manually operated doors, counterbalancing mechanisms have been used for many years to counterbalance the weight of the door and control its opening and closing movements so that one person can control the operation of the door more easily. Counterbalancing mechanisms are also advantageous for power operated overhead doors since they reduce the power requirements needed for the motor and they lower the structural strength required for the door opening and closing mechanism. In other words, lighter weight, lower cost, door controlling mechanisms, such as chain hoists for example, may be used if a counterbalancing mechanism is connected to the door to assist it in its opening and closing movements. Furthermore, the provision of a counterbalancing mechanism minimizes the chance of a rapid and uncontrolled closing of the door in the event of a failure of the door opening and closing mechanism, which can result in serious damages or even personal injuries.

It is also known in the art that a widely used type of counterbalancing mechanism generally comprises a pair of spaced apart cable drums connected to cables, each cable being in turn connected to a lower opposite side edge of the garage door. The cable drums are usually mounted onto an overhead shaft which is supported above the door opening and is connected to one or more torsion springs which are each fixed to the shaft at one end, and secured to a fixed structure such as the wall for example at the other end, so that the cable drums are biased to rotate in a direction which winds the cables onto the drums and counteracts the weight of the door connected to the cables. The torsion springs are adjusted to properly balance the weight of the door so that minimal opening and closing efforts are required, either manually or when motor controlled. An example of a conventional cable-operated sectional door and its corresponding counterbalancing mechanism is shown in FIG. 1, the sectional door being shown provided with a chain hoist for raising and lowering the door.

It is also known in the art that certain garage doors are not always properly counterbalanced or simply are operated without the use of a counterbalancing mechanism. Since these doors are not properly counterbalanced or are simply not counterbalanced at all, they are either always pulling on the cables with a downward force due to the weight of the door, or have a tendency to move upwards because the counterbalancing force of their torsional springs is too strong. This type of situation is particularly dangerous when the door is raised or lowered by means of a conventional drive mechanism, such a manually-operated chain hoist for example, because an operator needs to continuously hold the chain of the hoist, otherwise the door may fall to the ground or move up in an uncontrolled manner with an increasing speed. Such a situation is dangerous and often arises suddenly, particularly in the case of commercial doors which are known to be heavier than residential doors, because as soon as the hand chain of the hoist slips away from an operator's hand, its speed tends to increase to a level that is practically impossible and/or very unsafe to stop manually, thereby often resulting in the door raising up or dropping in a very undesirable manner, i.e. with an increasing speed, which often in turn results into serious damages and/or personal injuries. Indeed, not only is the door itself dangerous when falling or moving up in an uncontrolled manner because it may severely impact an item or a person, but also hand injuries are very likely to occur when an operator of the chain hoist attempts to regain control of the chain which often rotates much faster than the overhead shaft of the door.

There exist several prior art documents describing different drive mechanisms for use with sectional doors. Known to the Applicant are the following United Sates patents which describe different drive mechanisms and the safety devices used therewith: U.S. Pat. Nos. 1,621,951; 2,095,695; 2,878,865; 3,188,698; 3,637,004; 4,112,996; 4,669,775; 4,704,914; 4,721,146; 4,997,022; 5,022,452; 5,291,686; 5,482,103; 5,494,093; 5,971,055; 6,029,735; 6,042,158; 6,059,008; 6,070,641; and 6,123,134.

It is also known in the art that occasionally, for one reason or the other, one of the cable of the counterbalancing mechanism brakes or one of the elements holding such cables undergoes failure, leading to the garage door falling all the way down, potentially causing damages or personal injuries. There exist some systems that prevent the free falling of a garage door by breaking it in its track in the advent of a failure of the counterbalancing mechanism. There are also systems that stop the door (i.e. let it go up, but do not let it go down) in such circumstances. Finally, there are also systems that slow down the falling of the door in case of an emergency condition, such as a fire for example. However, there seems to be no drive mechanism which not only is used for raising and lowering a sectional door, such as garage doors and the like, but which also acts as a safety device for preventing an uncontrollable raising and/or lowering of the sectional door as a result of the aforementioned adverse situations.

Hence, in light of the above-discussed, there is a need for an improved drive mechanism which, by virtue of its design and components, would not only be able to raise and lower a sectional door, such as garage doors and the like, but would also act as a safety device for preventing an uncontrollable raising and/or lowering of the sectional door, whether the latter be balanced, unbalanced or improperly balanced.

SUMMARY OF THE INVENTION

The object of the present invention is to provide a drive mechanism which satisfies some of the above-mentioned needs and which is thus an improvement over the devices known in the prior art.

In accordance with the present invention, the above object is achieved with a drive mechanism for use with an overhead shaft of a sectional door for raising and lowering said door via a rotation of the overhead shaft, the drive mechanism comprising:

support means through which the overhead shaft is pivotally inserted;

a first gear securely mounted about the overhead shaft of the sectional door;

a drive shaft pivotally mounted to the support means;

a second gear securely mounted about the drive shaft, the second gear being operatively interconnected to the first gear so that a rotation of the second gear is transmitted to the first gear and vice versa, the second gear being rotatable along a first direction corresponding to a raising of the sectional door and along an opposite second direction corresponding to a lowering of the sectional door;

a pocket wheel mounted about the drive shaft and being rotatably movable therealong between a first position where the pocket wheel is away from the second gear and a second position where the pocket wheel is operatively secured against the second gear and where further rotation of the pocket wheel biases the second gear to rotate along the first direction; and actuating means for rotating the pocket wheel about the drive shaft, operating the said pocket wheel between the first and second positions, and driving the second gear along the first and second directions when the pocket wheel is in the first and second positions respectively.

According to a first preferred embodiment of the invention, the drive mechanism comprises a single ratchet assembly for blocking rotation of the second gear along the second direction when the pocket wheel is in the second position.

According to a second preferred embodiment of the invention, the drive mechanism comprises a second ratchet assembly for blocking rotation of the second gear along the first direction when the pocket wheel is in the first position The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

In the following description, the same numerical references refer to similar elements. The embodiments shown in FIGS. 2–6 are preferred.

Although the present invention was primarily designed for use with a cable-operated counterbalanced sectional garage door, it may be used with other types of doors, such as slidable truck doors, or with any other items which can be opened or closed by means of a chain hoist, as apparent to a person skilled in the art. For this reason, the expressions such "cable-operated", "counterbalanced", "sectional", "garage" and/or "door" and any other references and/or other expressions equivalent thereto should not be taken as to limit the scope of the present invention and include all other kinds of doors or items with which the present invention could be used and may be useful.

Moreover, in the context of the present invention, the expressions "sectional door", "cable-operated door" and/or "garage door", as well as any other equivalent expressions and/or compound words thereof, may be used interchangeably, as apparent to a person skilled in the art. The same applies for any other mutually equivalent expressions known in the art, such a "drive mechanism" and "chain hoist" for example, as well as "counterbalanced" and balanced", as also apparent to a person skilled in the art.

In addition, although the preferred embodiment of the present invention as illustrated in the accompanying drawings comprises various components such as a pair of ratchet gears, pawl arms, friction pads, washers, a chain, a threaded drive shaft, etc., and although the preferred embodiment of the present invention as shown consists of certain geometrical configurations, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the drive mechanism according to the present invention, as will be explained hereinafter, without departing from the scope of the invention.

Figure 1:
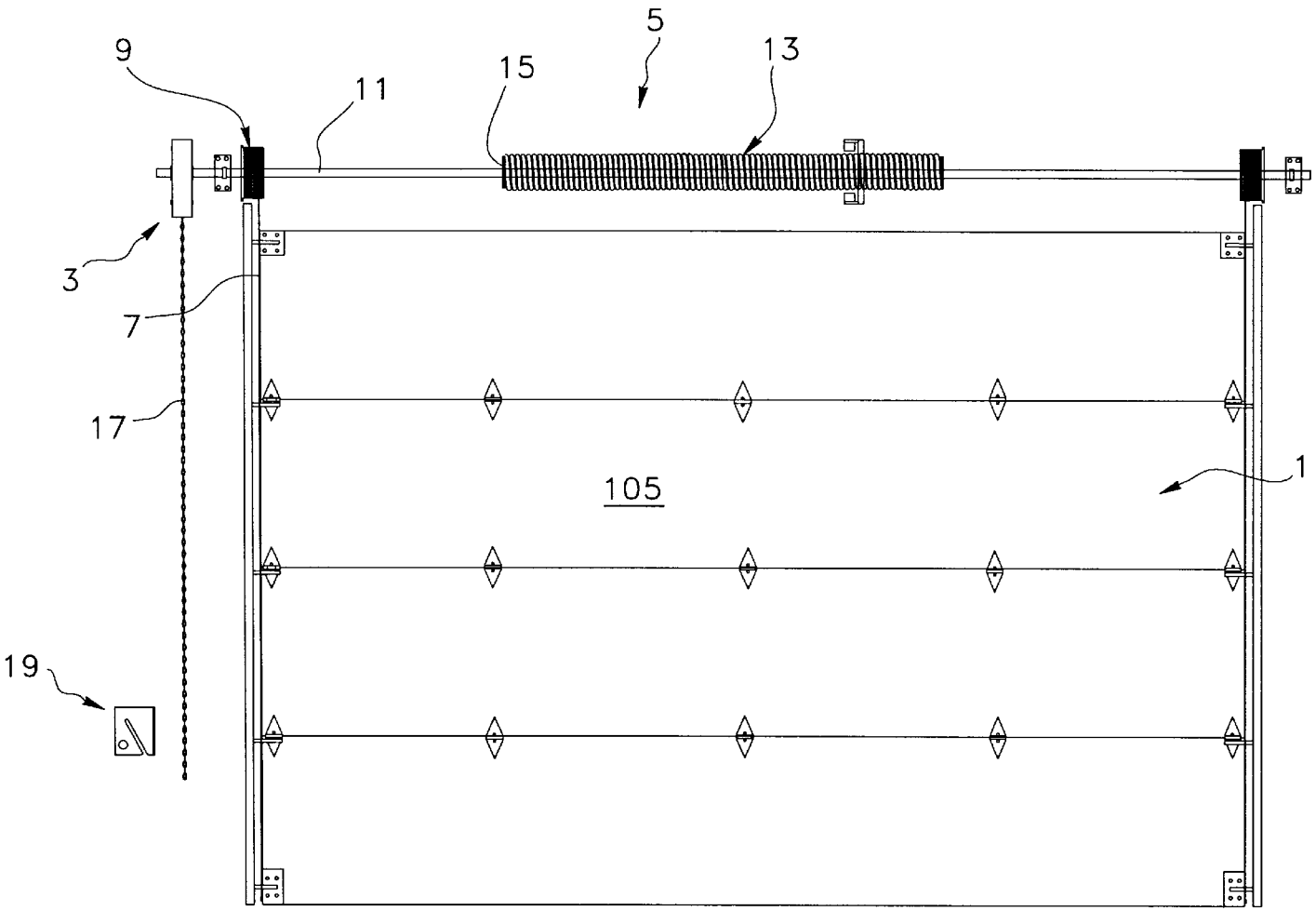
PRIOR ART FIG. 1
FIG. 1 is a schematic front view of a conventional cable-operated counterbalanced sectional garage door, the sectional door being shown provided with a drive mechanism according to the prior art.

Referring to FIG. 1, there is shown a schematic front view of a conventional cable-operated counterbalanced sectional garage door 1, the sectional door 1 being shown provided with a chain hoist 3. Indeed, most sectional doors 1, whether manually or power-operated, are connected to an overhead counterbalancing mechanism 5 that provides a counterbalancing force in order to decrease the force required to open the door 1 and also facilitate its closing. The garage door 1 is usually connected to the counterbalancing mechanism 5 by means of two cables 7, one at the right and one at the left. The cables 7 are usually made of steel and the lower free end of each cable 7 is usually attached at the bottom of the door 1. As is known in the art, each cable 7 cooperates with a corresponding cable drum 9 which is mounted to the overhead support shaft 11 in order to facilitate raising and lowering of the cable-operated sectional door 1. Torque is transferred between the torsional springs 13 and the overhead shaft 11 by means of plugs 15 which operatively connect the shaft 11 to the springs 13 in order to counterbalance the weight of the garage door 1. Since the cables 7 are respectively coiled up onto a corresponding drum 9 that is mounted on the door shaft 11, a rotation of the door shaft 11 along one direction moves the door 1 upwards while a rotation of the door shaft 11 along another direction moves the door 1 downwards.

As is known in the art, chain hoists 3 are usually operatively connected to the overhead shaft 11 of sectional doors 1 for driving the same in order to ease the opening and the closing of such doors 1. They ease the manipulation by giving access to high height doors 1 or height offset doors 1, for example, and by reducing the initial pulling force needed in the hand chain caused by door's inertia. Because most doors 1 are counterbalanced, the only point in time at which one usually needs to substantially pull on the hand chain 17 of the hoist 3 with some force is at the beginning of the door raising movement, after which, one only has to assist the raising movement of the door 1 with a minimal pulling force. Also, because most doors 1 are not perfectly counterbalanced, one can let go off the chain 17 of the hoist 3 and the door 1 will continue to move upwards or downwards, accordingly, in a fairly slow manner due to the presence of the counterbalancing mechanism 5 of the door 1. This is why chain keepers 19 are widely used, because they enable to selectively prevent any movement of the chain 17, and thus block the raising and/or lowering of the door 1.

Similarly, in the case of a conventional non-counterbalanced sectional garage door 1, the door 1 is attached, on its leaf, with two cables 7, one on each side. These cables 7 are coiled up on a drum 9 that is mounted on the door shaft 11. Thus, the rotation of the door shaft 11 also moves the door 1 upwards and downwards accordingly. A non-counterbalanced or "unbalanced" door 1 does not have torsion springs 13 mounted onto the door shaft 11, so that the door weight is not balanced.

Chain hoists 3 are also used to ease the opening and the closing of such unbalanced doors 1. They ease the manipulation by giving access to high height doors 1 or height offset doors 1, for example, and by reducing the pulling force needed in the hand chain 17 to move the door 1. However, because the door 1 is not balanced, one always need to substantially pull on the chain 17 of the hoist 3 in order to raise and/or lower the door 1. To stop the door 1 at a given position, one needs to <<lock>> the chain 17 in a chain keeper 19. For unbalanced doors 1, the chain keeper 19 now becomes an essential accessory of the door 1 because it will prevent the free falling or the rapid rising of the door 1. Finally, because the door 1 is not balanced, if one lets go off the chain 17, the door 1 will fall with an increasing speed and thus will be unstoppable, increasing the possibilities of injuries and/or damages to property and the door mechanism.

Broadly described, the drive mechanism 101 according to the present invention, as illustrated in the accompanying drawings, is a drive mechanism 101 for use with an overhead shaft 103 of a sectional door 105 for raising and lowering said door 105 via a rotation of the overhead shaft 103. As better shown in FIGS. 2 and 6, the drive mechanism 101 comprises support means 107, a first gear 109, a drive shaft 111, a second gear 113, a pocket wheel 115 and actuating means 117.

The overhead shaft 103 of the sectional door 105 is preferably pivotally inserted into the support means 107 of the drive mechanism 101 through corresponding bores 119 thereof. The first gear 109 is securely mounted about the overhead shaft 103 by appropriate fastening means, such a key way for example or any other suitable means, as apparent to a person killed in the art.

Figure 2:
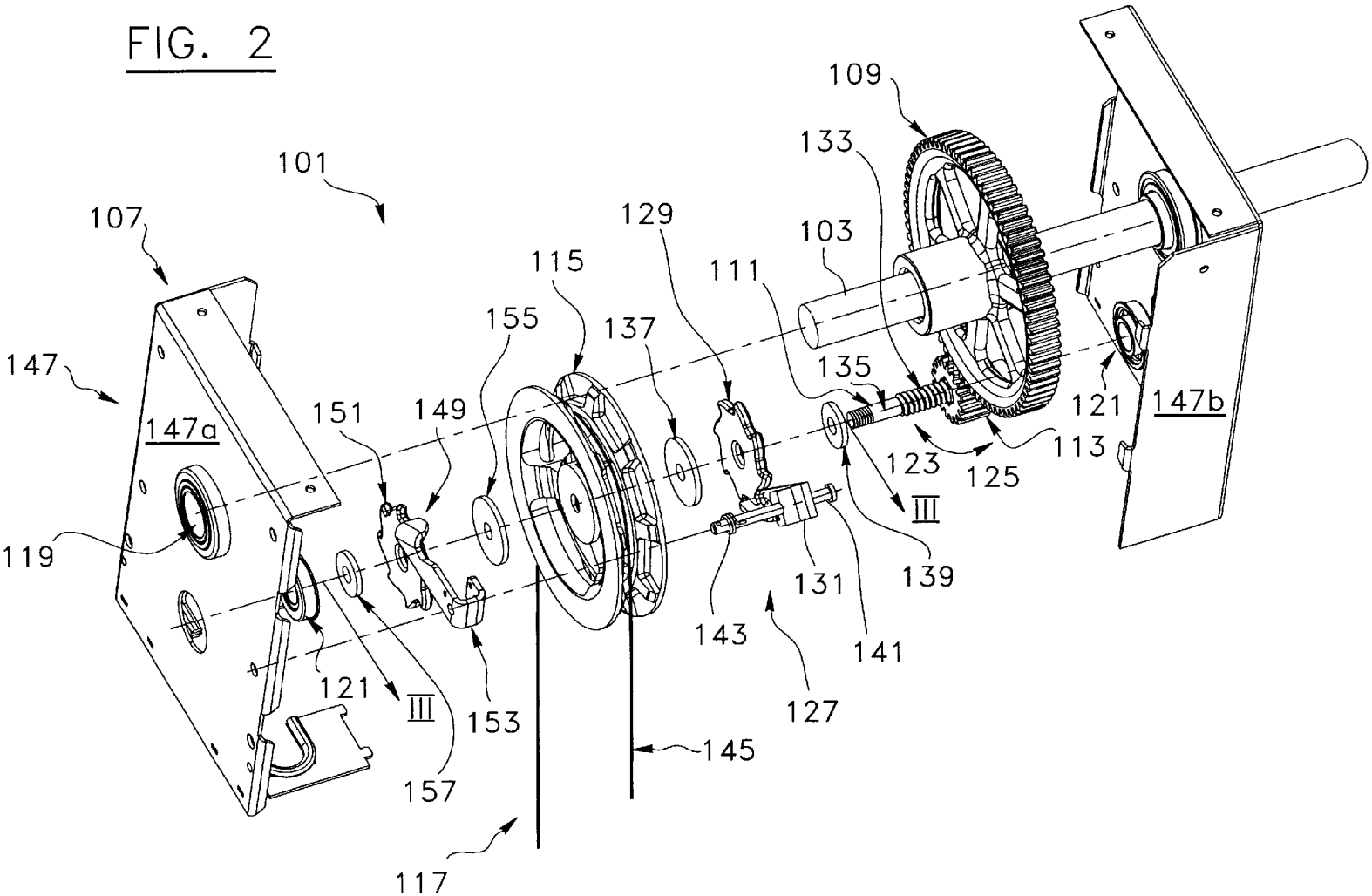
FIG. 2 a perspective exploded view of a drive mechanism according to the preferred embodiment of the invention, the drive mechanism being shown cooperating with an overhead shaft of a sectional door.

The drive shaft 111 is pivotally mounted to the support means 107 and preferably rotates about corresponding sleeves 121 thereof, as also better shown in FIG. 2. The second gear 113 is securely mounted about the drive shaft 111 and is operatively interconnected to the first gear 109 so that a rotation of the second gear 113 is transmitted to the first gear 109 and vice versa, as can be easily understood when referring to FIG. 2. The second gear 113 is rotatable along a first direction 123 corresponding preferably to a raising of the sectional door 105 and along an opposite second direction 125 corresponding preferably to a lowering of the sectional door 105. Alternatively, it is worth mentioning that, still according to the present invention, the first and second directions 123, 125 along which the drive shaft 111 rotates may correspond to the lowering and raising movements of the door 105 respectively, depending on how the cables of the door 105 are wound about the drums and/or depending on how the sectional door 105 rotates about the overhead shaft 103, as apparent to a person skilled in the art.

The pocket wheel 115 is mounted about the drive shaft 111 and is rotatably movable therealong between a first position where the pocket wheel 115 is away from the second gear 113 and a second position where the pocket wheel 115 is operatively secured against the second gear 113 and where further rotation of the pocket wheel 115 biases the second gear 113 to rotate along the first direction 123, as can be easily understood when referring to FIG. 2.

The actuating means 117 are used for rotating the pocket wheel 115 about the drive shaft 111, operating the said pocket wheel 115 between the first and second positions, and driving the second gear 113 along the first and second directions 123, 125 when the pocket wheel 115 is in the second and first positions respectively.

According to a preferred embodiment of the invention, the drive mechanism 101 comprises a first ratchet assembly 127 for blocking rotation of the second gear along 113 the second direction 125 when the pocket wheel 115 is in the second position. This first ratchet assembly 127 preferably comprises a ratchet gear 129 and a pawl arm 131 positioned and sized to cooperate with said ratchet gear 129, the ratchet gear 129 being mounted about the drive shaft 111 between the pocket wheel 115 and the second gear 113 and being rotatably movable therealong. Preferably, as can be understood when referring to FIGS. 2 and 3, the ratchet gear 129 is rotatable about the driving shaft 111 when the pocket wheel 115 is in the first position and is securely clamped between the pocket wheel 115 and the second gear 113 when the pocket wheel 115 is in the second position so as to be blocked by the pawl arm 131 when the second gear 113 is rotated along the second direction 125 by the first gear 109.

Figure 4:
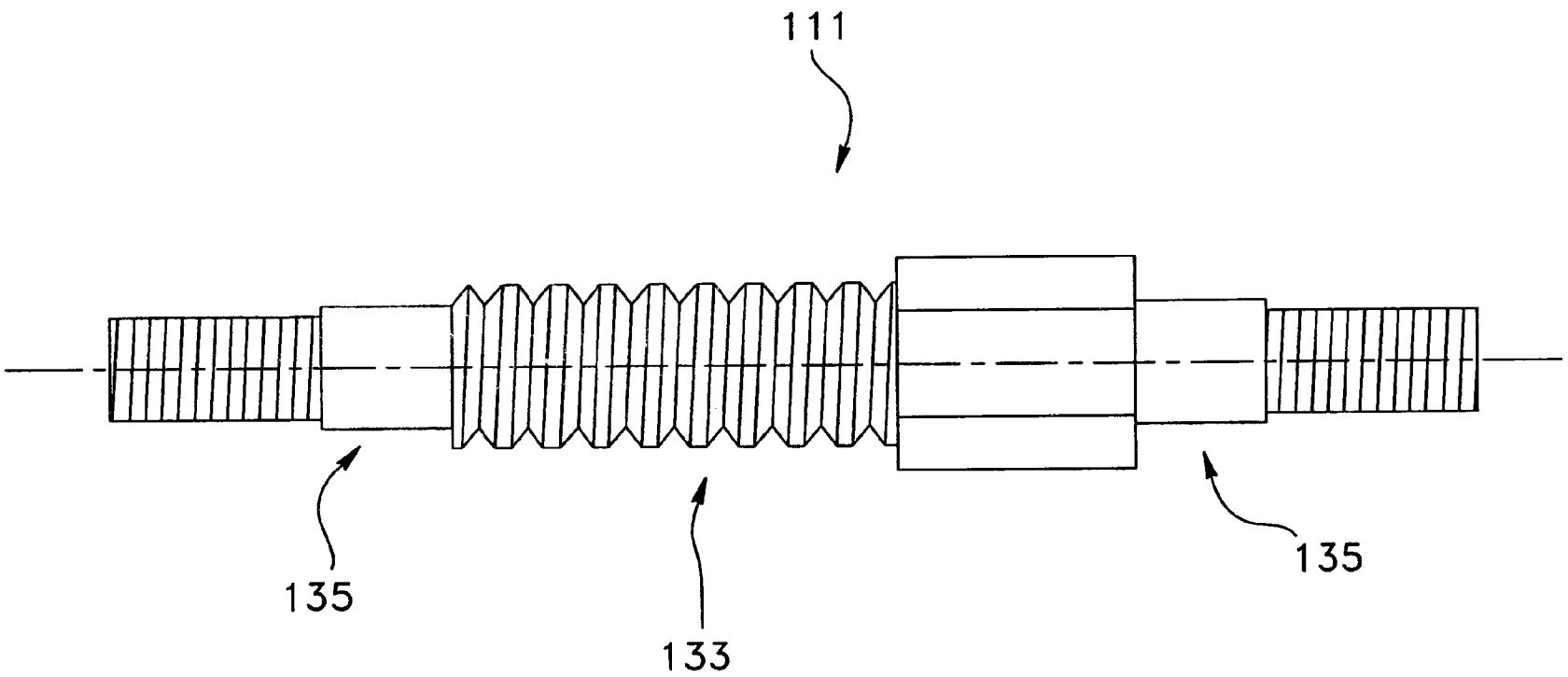
FIG. 4 is a schematic side view of the drive shaft shown in FIG. 2.
Figure 5:
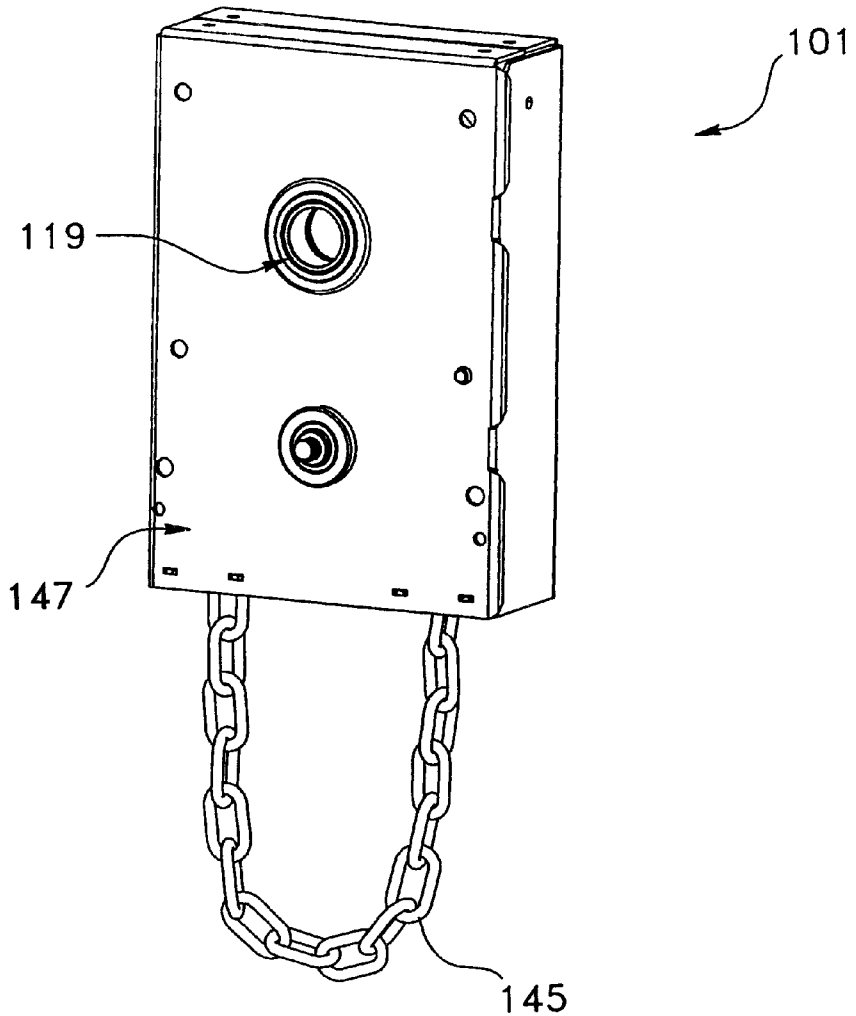
FIG. 5 is side view of the drive mechanism of FIG. 2 when in an assembled configuration.
Figure 6:
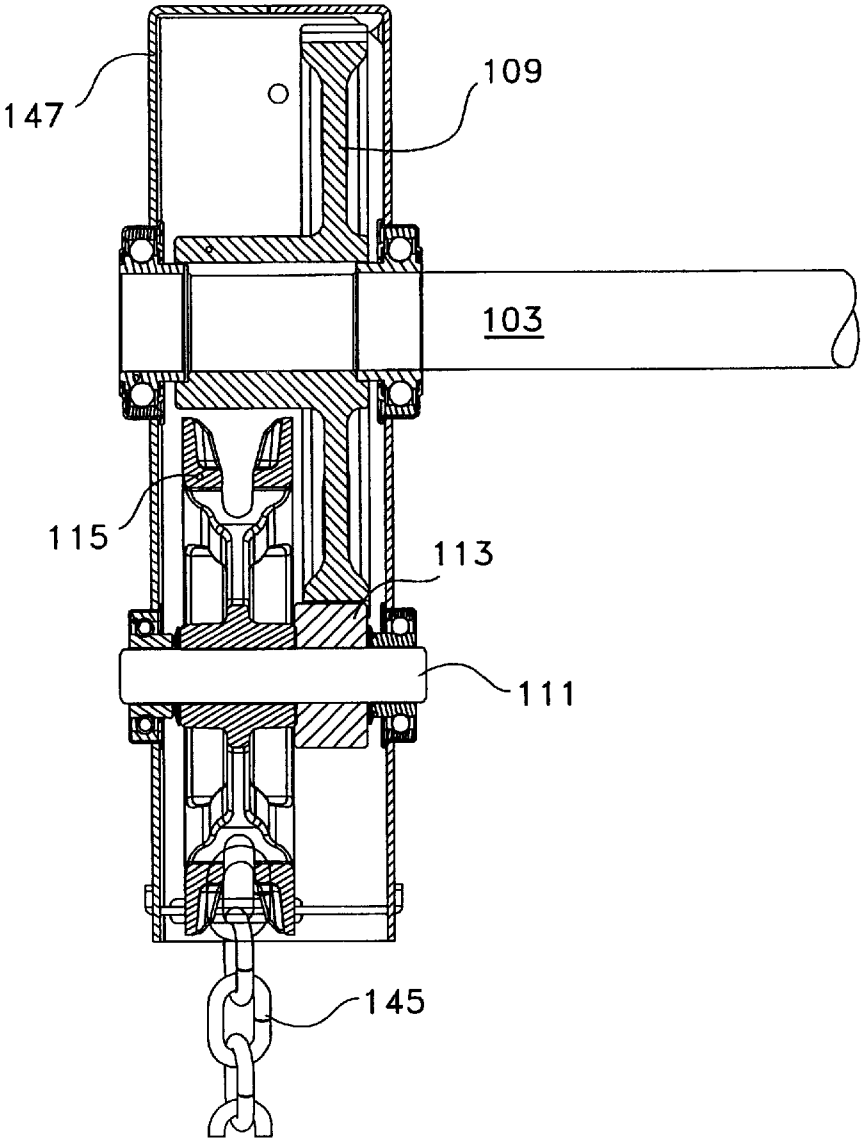
FIG. 6 is a cross-sectional view of a drive mechanism according to another preferred embodiment of the invention.

Preferably, the drive shaft 111 comprises a threaded portion 133 and first and second opposite segments 135, as better shown in FIG. 4. Preferably also, the first and second segments 135 of the drive shaft 111 are peripherally smooth and are mounted into corresponding support sleeves 121 of the support means 107 while the pocket wheel 115 and the ratchet gear 129 are threadedly mounted about and movable along the threaded portion 133 of the drive shaft 111, as better shown in FIG. 2. The end extremities of the drive shaft 111 are preferably threaded for receiving suitable fasteners and so as to securely mount the drive shaft 111 onto the support means 107, as apparent to a person skilled in the art.

Figure 3:
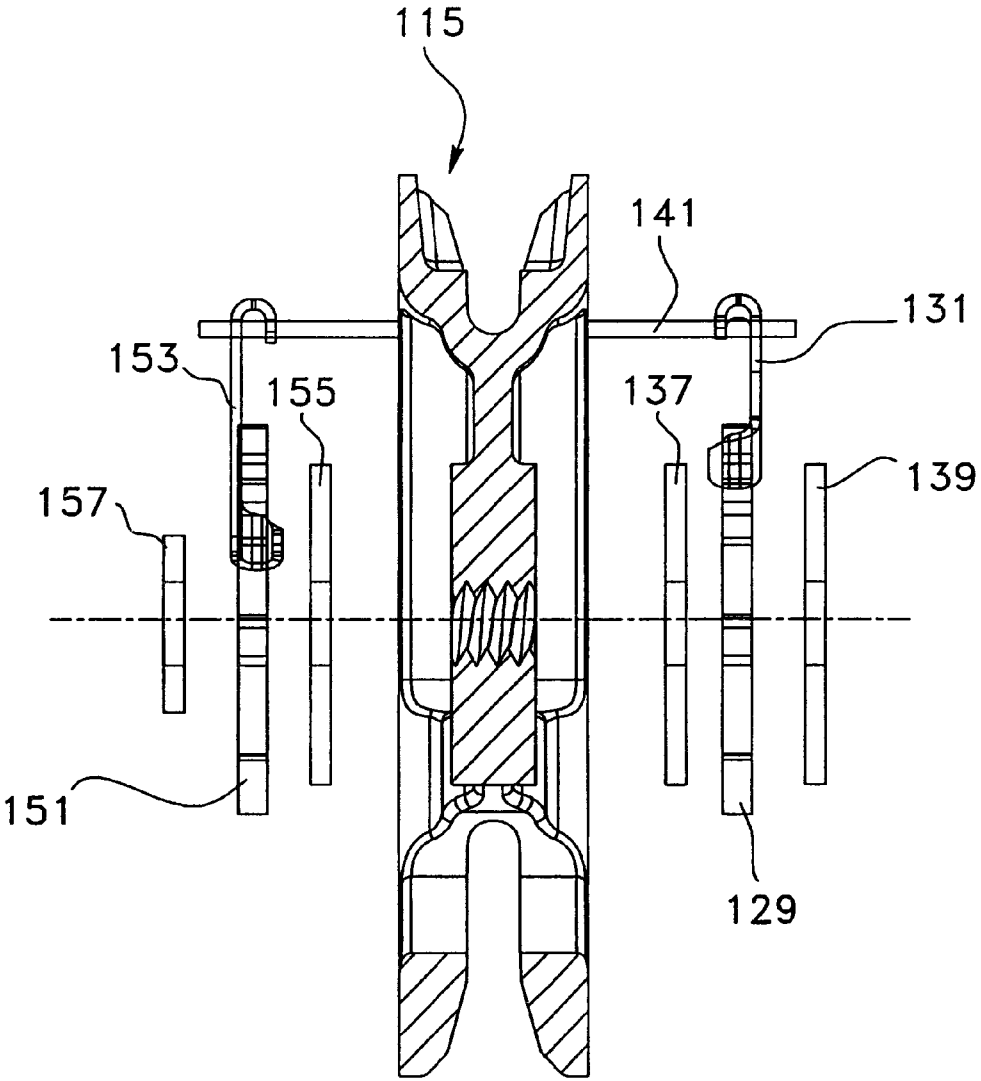
FIG. 3 is schematic cross-sectional view taken along line III—III of the drive mechanism shown in FIG. 2.

As better shown in FIGS. 2 and 3, the drive mechanism 105 preferably comprises a friction pad 137 mounted about the drive shaft 111 between the pocket wheel 115 and the ratchet gear 129, as well as a washer 139 mounted about the drive shaft 111 between the ratchet gear 129 and the second gear 113. Preferably, the washer 139 is intended to provide a good contact surface between the second gear 113 and the ratchet gear 129 (and also between the bearing and the ratchet gear 129) while the friction pad 137 is preferably intended to optimize the contact surface between neighboring parts and also help to have a good friction between the pocket wheel 115 and the ratchet gear 129, as apparent to a person skilled in the art.

Preferably also, as better illustrated in FIG. 2, the pawl arm 131 is mounted onto a rod 141, the rod 141 being pivotally mounted to the support means 107 and being provided with a spring 143 having one end connected to the support means 107 and another end connected to the rod 141 for biasing the pawl arm 131 against the ratchet gear 129.

Preferably also, the actuating means 117 comprise a chain 145 mounted about the pocket wheel 115 for rotating the same about the drive shaft 111 between the first and second positions and for driving the second gear 113 along the first and second directions 123, 125 when the pocket wheel 115 is in the second and first positions respectively, as can be easily understood when referring to FIG. 2. Instead of a manually pulled chain 145, the actuating means 117 may consist of other suitable means for rotating the pocket wheel 115 about the drive shaft 111, such a motorized driving device operatively connected to the pocket wheel 115 for example, or another slidable gear system connected to the pocket wheel 115, as apparent to a person skilled in the art.

The support means 107 preferably comprise a casing 147 formed of two portions 147*a*, 147*b* which are removably connectable to one another by suitable means, such as fasteners, hooks, etc., so as to allow an easy opening and closing of the casing 147 in order to facilitate the inspection, maintenance and/or repair of the components of the drive mechanism 101 inside the casing 147.

According to the present invention, the use of the drive mechanism 101, also commonly referred to commonly as "anti-back drive" 101, enables to remove the potential dangers inherent to unbalanced garage doors 105 without having to resort to the addition of a counterbalancing system. Indeed, the ratchet assembly 127 of the drive mechanism 101 acts as an "integrated braking device" which is devised to prevent any downward movement of the door 105, thus limiting damages and/or injuries. In fact, the drive mechanism 101 according to the first preferred embodiment explained hereinabove does not allow a downward movement of the door 105 without actuating the pocket wheel 115 back into the first portion.

Indeed, as can be understood when referring to FIG. 2, by pulling the hand chain 145, the pocket wheel 115 rotates about the drive shaft 111 on which the second gear 113 is securely mounted. The second gear 113 carries the first gear 109 which is securely mounted about the door shaft 103. Preferably, the parameters of the first and second gears 109, 113 (dimensions, teeth, etc.) are selected so that the rotational speed of the door shaft 103 is smaller than the rotational speed of the drive shaft 111.

As aforementioned, the drive shaft 111 has a threaded portion 133 on one side and the second gear 113 is rigidly mounted at the other side of the same shaft 111. The bore of the pocket wheel 115 is preferably threaded so as to be screwed onto the threaded portion 133 of the drive shaft 111. The pocket wheel 115 moves onto the ratchet gear 129 when screwed onto the drive shaft 111 by means of the chain 145. The ratchet gear 129 is rotatably movable along the axis of the drive shaft 111 so that when the pocket wheel 115 is screwed onto the ratchet gear 129, the latter is rotated until it abuts onto the second gear 113 which is rigidly mounted about the drive shaft 111. When all of these three (3) components (pocket wheel 115, ratchet gear 129 and second gear 113) are operatively clamped together, the drive shaft 111 begins to rotate around its axis and the second gear 113 thus carries the first gear 109 in rotation in order to move the door 105 in the first direction 123, corresponding to an upward movement of the door 105.

When a user of the drive mechanism 101 lets go off the hand chain 145, since the door 105 is not balanced, the door shaft 103 carries the first gear 109 which in turn carries the second gear 113 which is rigidly mounted onto the drive shaft 111 and secured against the ratchet gear 129 and the pocket wheel 113. A downward movement of the door 105 will thus screw the pocket wheel 115 onto the ratchet gear 129 and onto the second gear 113. Therefore, as can be easily understood, the pawl arm 131 will engage with the ratchet gear 129 and will prevent the same from rotating, because the ratchet gear 129 is clamped between the second gear 113 and the pocket wheel 115 (when the latter is in the second position). Hence, because the ratchet gear 129 is blocked, the second gear 113 is also blocked which means that drive mechanism 101 prevents the first gear 109 from rotating along the second direction 125, and thus prevents the door 105 from going down because the overhead shaft 103 is blocked by the first gear 109.

The only way one may release the door 105 is to create a slack between the ratchet gear 129, the second gear 113 and the pocket wheel 115, i.e. trigger the pocket wheel 115 back into the first position, away from the second gear 113. In order to do so, the user needs to move the hand chain 145 with a constant tension preferably. As soon as the tension is released in the hand chain 145, the pocket wheel 115 screws back onto the ratchet gear 129 that moves onto the second gear 113 and ultimately prevents any downward movement of the door 105 by preventing rotation of the second gear 113 in the manner explained hereinabove. It is to be understood that a minimum door weight is required for the drive mechanism 101 to be functional in the manner explained herein, as apparent to a person skilled in the art.

According to another preferred embodiment of the present invention, the drive mechanism 101 may also comprise a second ratchet assembly 149 for blocking rotation of the second gear 113 along the first direction 123 when the pocket wheel 115 is in the first position. This two-ratchet-assembly drive mechanism 101 allows the installation of the chain hoist 101 on any side of the garage door 105 as well as the possibility to flip it toward its own plane, if need may be.

Indeed, according to this particular embodiment, as better shown in FIG. 2, the drive mechanism 101 preferably comprises a second ratchet gear 151 and a second pawl arm 153 positioned and sized to cooperate with said second ratchet gear 151. As shown, the second ratchet gear 151 is mounted about the drive shaft 111 between the pocket wheel 115 and an abutment of the drive shaft 111 opposite to the second gear 113 and is rotatably movable therealong. As can be easily understood, the second ratchet gear 151 is rotatable about the drive shaft 111 when the pocket wheel 115 is in the second position and is securely clamped between the pocket wheel 115 and the abutment of the drive shaft 111 when the pocket wheel 115 is the first position so as to be blocked by the second pawl arm 153 when the second gear 113 is rotated along the first direction 123 by the first gear 109.

Preferably, the pocket wheel 115 and the first and second ratchet gears 129, 151 are threadedly mounted about the threaded portion 133 of the drive shaft 111 and are movable therealong within their respective ranges.

According to this embodiment, the drive mechanism 101 comprises first and second friction pads 137, 155, the first friction pad 137 being mounted about the drive shaft 111 between the pocket wheel 115 and the first ratchet gear 129, and the second friction pad 155 being mounted about the drive shaft 111 between the pocket wheel 115 and the second ratchet gear 151. Preferably also, the drive mechanism 101 comprises first and second washers 139, 157, the first washer 139 being mounted about the drive shaft 111 between the first ratchet gear 129 and the second gear 113, and the second washer 157 being mounted about the drive shaft 111 between the second ratchet gear 151 and the abutment.

Preferably also, according to this embodiment, the first and second pawl arms 131, 153 are mounted onto a same rod 141, the rod 141 being pivotally mounted to the support means 107 and being provided with a spring 143 having one end connected to the support means 107 and another end connected to the rod 141 for biasing the first and second pawl arms 131, 153 against the first and second ratchet gears 129, 151 respectively, as better shown in FIG. 2.

With the addition of a second ratchet assembly 149, the drive mechanism 101 becomes particularly useful with doors 105 having counterbalancing mechanisms which are not perfectly adjusted. On such doors 105, at any moment in time during opening or closing, the counterbalancing system may carry the door 105 upwards or downwards, randomly. However, with the provision of two ratchet assemblies 127, 149 in the manner explained hereinabove, the drive mechanism 101 does not allow the door 105 to drive overhead shaft 103 in any of the directions. Indeed, movement of the door 105 becomes blocked along both directions 123, 125, i.e. second gear 113 is prevented from rotating along the first and second directions 123, 125, and the only way to raise or lower the door 105, i.e. to drive the overhead shaft 103, is to employ the pocket wheel 115 between the first and second positions respectively, in the manner explained herein.

The drive mechanism 101 and its integrated braking principle according to the present invention as explained herein may be used in different fields, as apparent to a person skilled in the art, and may take on further embodiments. For example, although gears 109, 113, 129, 151 have been used in the context of the present description, it could also be possible to use other transmission systems, as also apparent to a person skilled in the art, such as sprockets with roller chains, for instance. The working principle would still remain the same, in that, according to the present invention, the drive mechanism 101 is devised to prevent movement to the door 105 coming from the output shaft (most of the time, the overhead door shaft 103), while enabling the door 105 to be raised or lowered by means of the input shaft (most of the time, it is the pocket wheel drive shaft 111).

As may now be appreciated, the present invention is a substantial improvement over the chain hoists known in the art, in that, as explained hereinabove, it prevents a conventional garage door 105 from free falling or moving upwards in an uncontrolled manner, and thus there is no need for chain keepers 19. Indeed, the drive mechanism 101 according to the present invention is built with an integrated brake device, preventing unwanted and dangerous motions of the door 105. According to the present invention, the drive mechanism 101 is advantageous in that, as explained hereinabove, it can be used with a door 105 which may be unbalanced in either the downward or upward direction, even though most unbalanced situations arise in the downward direction. Load can be moved up and down with the drive mechanism 101 but cannot go down by its own weight, therefore eliminating the risk of serious injuries caused by the door closing too rapidly for example. Furthermore, the present invention may be used in the garage door industry, with balanced or unbalanced garage doors 105, whether they be new or old. As it is evident from reading the above description, the present invention is a more reliable and safer drive mechanism 101 than those available in the prior art. Furthermore, the present invention may be used with other kinds of doors 105, such as slidable truck doors 105 for example, or with any other items which are operated by chain hoist 101, as apparent to a person skilled in the art.

Of course, numerous modifications could be made to the above described embodiments without departing from the scope of the invention as defined in the appended claims.

What is claimed is:

1. A drive mechanism for use with an overhead shaft of a sectional door for raising and lowering said door via a rotation of the overhead shaft, the drive mechanism comprising:

support means through which the overhead shaft is pivotally inserted;

a first gear securely mounted about the overhead shaft of the sectional door;

a drive shaft pivotally mounted to the support means;

a second gear securely mounted about the drive shaft, the second gear being operatively interconnected to the first gear so that a rotation of the second gear is transmitted to the first gear and vice versa, the second gear being rotatable along a first direction corresponding to a raising of the sectional door and along an opposite second direction corresponding to a lowering of the sectional door;

a driving link mounted about the drive shaft and being rotatably movable therealong between a first position where the driving link is away from the second gear and a second position where the driving link is operatively secured against the second gear and where further rotation of the driving link biases the second gear to rotate along the first direction; and actuating means for rotating the driving link about the drive shaft, operating the driving link between the first and second positions, and driving the second gear along the first and second directions when the driving link is in the second and first positions respectively.

2. A drive mechanism according to claim 1, wherein the drive mechanism comprises a first ratchet assembly for blocking rotation of the second gear along the second direction when the driving link is in the second position.

3. A drive mechanism according to claim 2, wherein the first ratchet assembly comprises a ratchet gear and a pawl arm positioned and sized to cooperate with said ratchet gear, the ratchet gear being mounted about the drive shaft between the driving link and the second gear and being rotatably movable therealong, the ratchet gear being rotatable about the driving shaft when the driving link is in the first position and being securely clamped between the driving link and the second gear when the driving link is the second position so as to be blocked by the pawl arm when the second gear is rotated along the second direction by the first gear.

4. A drive mechanism according to claim 3, wherein the drive shaft comprises a threaded portion and wherein the driving link and the ratchet gear are threadedly mounted about said portion and movable therealong.

5. A drive mechanism according to claim 4, wherein the drive shaft further comprises first and second opposite segments, said segments being peripherally smooth and being mounted into corresponding support sleeves of the support means.

6. A drive mechanism according to claim 3, wherein the drive mechanism comprises a friction pad mounted about the drive shaft between the driving link and the ratchet gear.

7. A drive mechanism according to claim 3, wherein the drive mechanism comprises a washer mounted about the drive shaft between the ratchet gear and the second gear.

8. A drive mechanism according to claim 3, wherein the pawl arm is mounted onto a rod, the rod being pivotally mounted to the support means and being provided with a spring having one end connected to the support means and another end connected to the rod for biasing the pawl arm against the ratchet gear.

9. A drive mechanism according to claim 1, wherein the actuating means comprise a chain mounted about the driving link for rotating the same about the drive shaft between the first and second positions and for driving the second gear along the first and second directions when the driving link is in the second and first positions respectively.

10. A drive mechanism according to claim 1, wherein the support means comprise a casing.

11. A drive mechanism according to claim 2, wherein the drive mechanism comprises a second ratchet assembly for blocking rotation of the second gear along the first direction when the driving link is in the first position.

12. A drive mechanism according to claim 3, wherein the drive mechanism comprises a second ratchet gear and a second pawl arm positioned and sized to cooperate with said second ratchet gear, the second ratchet gear being mounted about the drive shaft between the driving link and an abutment of the drive shaft opposite to the second gear and being rotatably movable therealong, the second ratchet gear being rotatable about the drive shaft when the driving link is in the second position and being securely clamped between the driving link and the abutment of the drive shaft when the driving link is the first position so as to be blocked by the second pawl arm when the second gear is rotated along the first direction by the first gear.

13. A drive mechanism according to claim 12, wherein the drive shaft comprises a threaded portion and wherein the driving link and the first and second ratchet gears are threadedly mounted about said portion and movable therealong.

14. A drive mechanism according to claim 13, wherein the drive shaft further comprises first and second opposite segments, said segments being peripherally smooth and being mounted into corresponding support sleeves of the support means.

15. A drive mechanism according to claim 12, wherein the drive mechanism comprises first and second friction pads, the first friction pad being mounted about the drive shaft between the driving link and the first ratchet gear, and the second friction pad being mounted about the drive shaft between the driving link and the second ratchet gear.

16. A drive mechanism according to claim 12, wherein the drive mechanism comprises first and second washers, the first washer being mounted about the drive shaft between the first ratchet gear and the second gear, and the second washer being mounted about the drive shaft between the second ratchet gear and the abutment.

17. A drive mechanism according to claim 12, wherein the first and second pawl arms are mounted onto a same rod, the rod being pivotally mounted to the support means and being provided with a spring having one end connected to the support means and another end connected to the rod for biasing the first and second pawl arms against the first and second ratchet gears respectively.

18. A drive mechanism according to claim 13, wherein the actuating means comprise a chain mounted about the driving link for rotating the same about the drive shaft between the first and second positions and for driving the second gear along the first and second directions when the driving link is in the second and first positions respectively.

19. A drive mechanism according to claim 13, wherein the support means comprise a casing.

20. A drive mechanism according to claim 1, wherein the driving link is a pocket wheel.

* * * * *